US008186986B2

(12) United States Patent
Schöttler et al.

(10) Patent No.: US 8,186,986 B2
(45) Date of Patent: May 29, 2012

(54) DEVICE FOR DRAWING FILAMENTS

(75) Inventors: Holger Schöttler, Klein Rönnau (DE); Dimitrios Sapouridis, Henstedt-Ulzburg (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 414 days.

(21) Appl. No.: 12/487,824

(22) Filed: Jun. 19, 2009

(65) Prior Publication Data

US 2009/0317505 A1 Dec. 24, 2009

(30) Foreign Application Priority Data

Jun. 21, 2008 (DE) ..... 10 2008 029 550

(51) Int. Cl.
*D01D 5/098* (2006.01)

(52) U.S. Cl. ..... 425/66; 425/72.2; 425/83.1; 425/188; 425/192 S

(58) Field of Classification Search ..... 425/66, 425/72.2, 83.1, 188, 192 R, 192 S
See application file for complete search history.

(56) References Cited

U.S. PATENT DOCUMENTS

| | | | | |
|---|---|---|---|---|
| 3,766,606 | A * | 10/1973 | Piper et al. | 28/283 |
| 6,379,136 | B1 * | 4/2002 | Najour et al. | 425/66 |
| 6,974,316 | B2 * | 12/2005 | Maggio | 425/66 |
| 6,979,186 | B2 * | 12/2005 | Schmit et al. | 425/72.2 |
| 2006/0172024 | A1 * | 8/2006 | Bentley et al. | 425/72.2 |

* cited by examiner

*Primary Examiner* — Yogendra Gupta
*Assistant Examiner* — Joseph Leyson
(74) *Attorney, Agent, or Firm* — BainwoodHuang

(57) ABSTRACT

A device for drawing melt-spun filaments for forming a spunbonded fabric includes at least one guide member. The filaments are guided through a slot-shaped nozzle, onto which compressed air is applied, and which conveys the filaments through the drawing nozzle. Guide members are provided on both sides of the slot on the base of the slot-shaped outlet, which cause a uniform structure of the fabric due to their shaping. This is achieved when a guide member has a plurality of notches parallel to the conveying direction, and the opposite guide member has a plurality of bores, which passively connect the space between the guide member with the environment.

13 Claims, 4 Drawing Sheets

DEVICE FOR DRAWING FILAMENTS

FOREIGN PRIORITY CLAIM

This Patent Application claims priority to German Patent Application No. 10 2008 029 550.7 filed on Jun. 21, 2008, entitled, "DEVICE FOR DRAWING FILAMENTS", the contents and teachings of which are hereby incorporated by reference in their entirety.

TECHNICAL FIELD

The invention relates to a device for drawing a plurality of filaments.

BACKGROUND

A conventional device for the production of a spunbonded fabric is known from US publication 2006/0172024. In order to produce a spunbonded fabric, a fusible polymer fed by an extruder is spun into a plurality of filaments by nozzle bores that are arranged in a linear manner, in single or multiple rows in a spinning beam, and subsequently cooled by a cooling device. A tensile force is exerted onto the filaments by a device for drawing that is arranged at a distance beneath, that is to say a drawing nozzle in the form of a slot, which tensile force causes the stretching and conveying of the filaments. For this purpose compressed air flows from the interior wall of the drawing nozzle into the conveying direction of the filaments, by way of which the desired tensile force is exerted onto the filaments. The filaments are deposited on a conveyor belt arranged beneath the drawing nozzle in a randomly oriented position, and form the fabric at that location.

In order to influence the airflow and the filaments during the discharge from the drawing nozzle, such that the deposit of the filaments is carried out as uniformly as possible, a finger strip having a pinnacle-shaped cross-section is provided. The finger strip is provided on the discharge side of the drawing nozzle, which extends across the width of the drawing nozzle.

SUMMARY

Despite prior art measures, there is still a risk that thin spots and the formation of filament bundles may occur in the spunbonded fabric due to an uneven deposit of the filaments in the spunbonded fabric.

The present invention provides an improved drawing nozzle in order to ensure a uniform thread deposit. Furthermore, the invention provides for flexible adjustability of the drawing nozzle to different process parameters such that an optimum adjustment can be achieved more readily.

For this purpose the drawing nozzle has a guide member on the base thereof, which extends across the length of the slot on the outlet side. The guide member is equipped with a plurality of bores, which connect the outlet region with the environment, thus enabling a passive exchange of air. In this manner the sudden expansion of the conveyor air into the environment is attenuated, since the pressure ratios directly at the outlet of the drawing nozzle can be adjusted to the pressure ratios of the environment more uniformly.

Surprisingly it has been shown that especially by using the combination of a guide member having notches in the conveying direction on the outlet side of the drawing nozzle on the one side of the slot, and a guide member having bores on the other side, particular advantages are achieved as compared to only one guide member.

In an alternative embodiment guide members are provided with bores on both sides of the slot.

In a particularly advantageous further improvement of the invention one of the guide members, or both guide members can be adjusted toward the conveyor direction with regard to the angle thereof. In this manner the effect of the guide member can be adjusted in a particularly fine manner, thus optimally adjusting the same to the process.

One preferred embodiment variation of the invention includes multiple rows of holes, in which the bores are inserted.

In a preferred further improvement, part of the bores is arranged above, and another part of the bores is arranged beneath the lower edge of the opposite guide members. A particularly uniform exchange of air with the environment can be achieved in this manner.

A soft flowing in of air is achieved by way of expanding the bores toward the interior of both guide members.

The soft flowing in of air is also achieved by way of interior notches, which extend from the bores in conveyor direction.

A uniform flow is also obtained if interior notches are provided beneath the bores without any connection to the bores.

In an embodiment variation, the bores are embodied in an angular manner, transverse to the conveying direction, at an angle of about 10 to 60°. The lateral speed component of the inflowing air executes an angular momentum onto the filaments, which aids in the formation of the randomly oriented positioning.

Another embodiment variation provides bores that are angularly arranged in the conveyor direction, which are provided in or opposite to the conveyor direction, at an angle of between about 10 to 60°. An inflow or outflow of air can be supported in this manner.

Even if according to the invention each angle of greater than 0° is included, the lower threshold of 10° is selected in order to thus obtain a transverse component. In manufacturing, any angles above 60° can be created only at great expense.

Optimum results are obtained using the device according to the invention, if the bore diameter is within a range of about 0.5 to 10 mm.

BRIEF DESCRIPTION OF THE DRAWINGS

One example embodiment is described in further detail below, based on the attached drawings in which:

FIG. 1 illustrates the device for melt sinning and drawing of filaments into a spunbonded fabric according to one embodiment of the invention. Fusible polymer is fed to a spinning unit 3 via a melt line 2 from a melt source 1, such as an extruder. The spinning unit 3 in this example comprises a pump (not illustrated) for increasing the pressure of and dosing the melt. Spinning nozzles 4 are provided on the base of the spinning unit 3, by which the melt is extruded into thin filaments, which exit the spinning unit 3 in the form of a filament bundle 5. The spinning nozzles 4, for example, may be inserted into multiple spinning nozzle plates, which are successively arranged perpendicular to the drawing plane. For this purpose more spinning nozzles 4 are provided perpendicular to the drawing plane by orders of magnitude, than are illustrated in the drawing plane and in FIG. 1. The filament bundle 5 therefore has the shape of a curtain, which extends perpendicular to the drawing plane.

Figure 1:
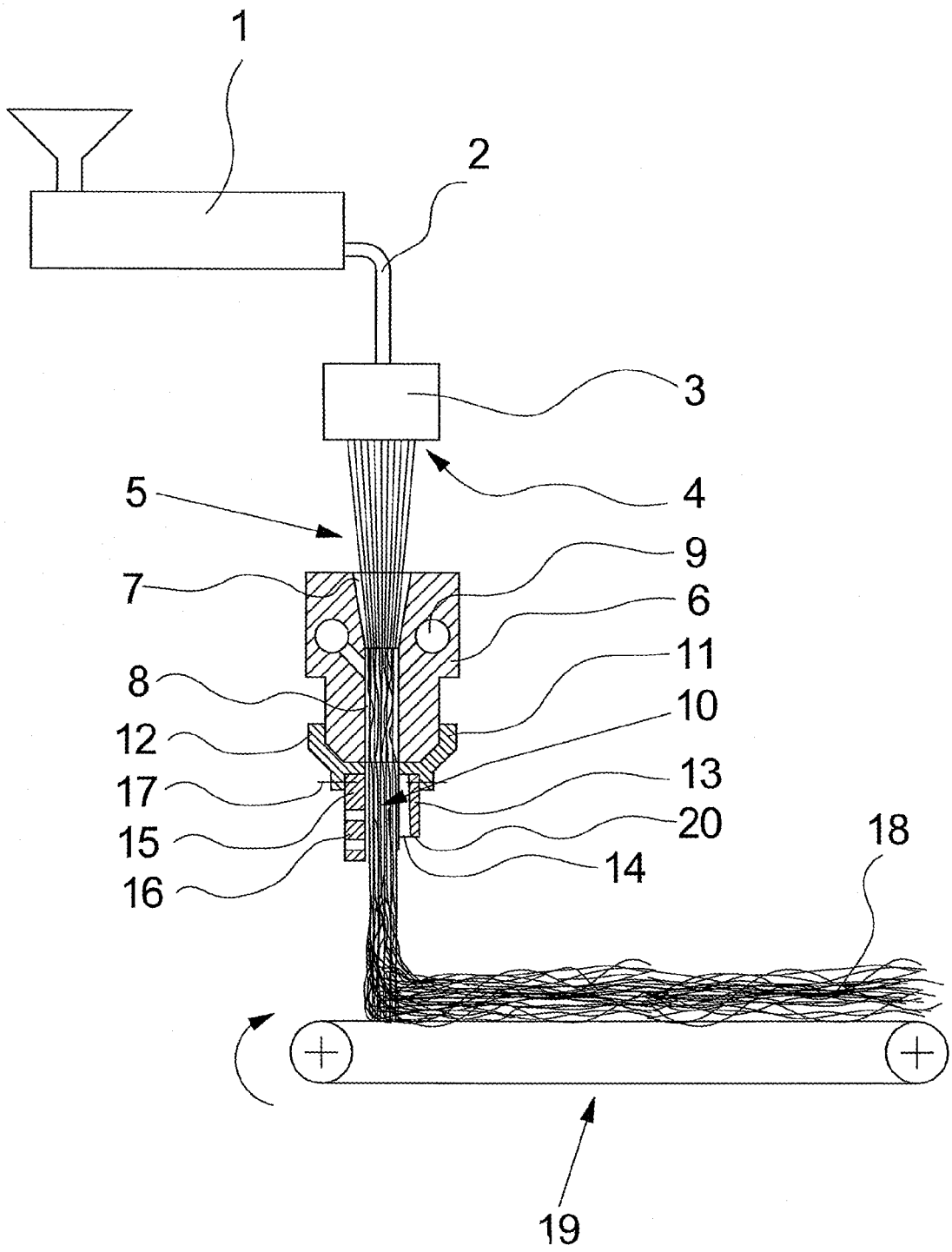
FIG. 1 illustrates a device for melt spinning and drawing of filaments into a spun-bonded fabric according to one embodiment of the invention.

The drawing nozzle 6 is located beneath the spinning unit 3, which also extends perpendicular to the drawing plane across the width of the filament bundle 5. A cooling device may be located above the drawing nozzle 6.

It is a function of the drawing nozzle 6 to exert a tensile force onto the filament bundle 5 and to convey the same. For this purpose the filament bundle 5 is guided through a funnel-shaped intake region 7 in the drawing region 8. A compressed air feed 9 is provided on both sides in the drawing region 8, via which the compressed air is fed, which is guided into the drawing region at an acute angle, and which exerts a tensile force onto the filament bundle at that location. The drawing region 8 forms a slot 10, which extends perpendicular to the drawing plane.

A conveyor belt 19 is provided beneath the drawing nozzle 6, on which the filament bundle discharged into a fabric 18 is transported.

The guide members 13 and 15 are attached directly beneath and in connection with the drawing nozzle 6 by receptacles 11 and 12. The optional receptacles 11 and 12 enable the quick and flexible installation of the guide members 13 and 15. In this manner the guide members 13 and 15 may be easily exchanged for other guide members having a deviating geometry, and adjusted to modified process parameters. The guide members 13 and 15 are positioned such that the slot 10 is continued beneath the drawing region.

The guide member 13 has a plurality of notches 14 perpendicular to the drawing plane, which extend in the conveying direction of the drawing nozzle, wherein the notch depth increases in the conveying direction. In this manner a more uniform airflow is achieved from the drawing nozzle 6 such that the filaments are distributed more evenly on the conveyor belt 19, thus creating a more uniform fabric 18. In addition to the guide member 13, another guide member 15 is provided in the form of a thin-walled strip, having a plurality of bores 16. For this purpose the bores 16 connect the space beneath the drawing region 7 of the drawing nozzle 6 with the environment, thus enabling an exchange of air with the environment. An aerodynamic, particularly uniform transition from the drawing region 7 into the environment is achieved in this manner. Due to the double-row arrangement of the rows of holes 16 (not illustrated), where the lower row of holes is arranged beneath the lower edge 20 of the guide member 13, the exchange of air may occur in a particularly uniform manner.

As an alternative to the arrangement illustrated, 2 guide member 15 including bores 16 may also be arranged on both sides of the slot 10.

Figure 2:
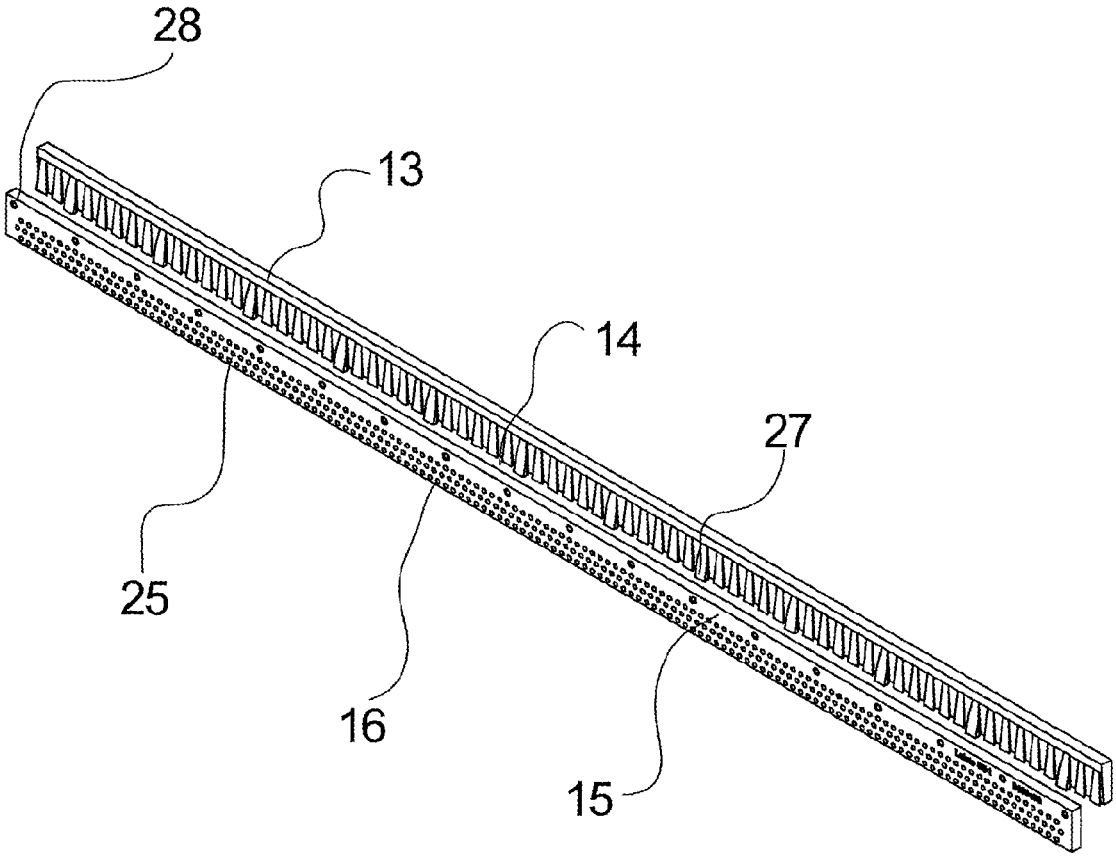
FIG. 2 illustrates a guide member provided at the base of the drawing nozzle.

The two guide members 13 and 15 are again illustrated in FIG. 2. The arrangement of the holes 16 in the guide member 15 represent a variation as opposed to the arrangement shown in FIG. 1. In this case three rows of holes are provided, which are each arranged above the lower edge 20 of the guide member 14. The guide member 14 has a plurality of notches 14 and bars 27. The bars 27 broaden into the shape of a dovetail parallel to the depth of the notches 14, increasing in the conveying direction.

Threaded bores 28 in the guide member 15, and in the guide member 14 (not illustrated), enable the simple installation of the guide member.

Figure 3:
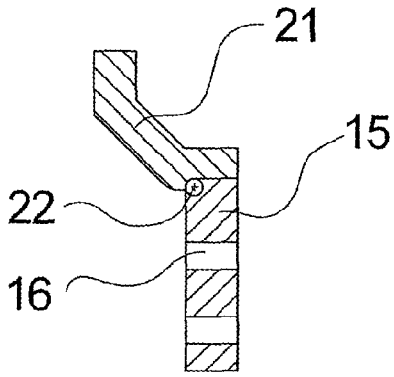
FIG. 3 illustrates an embodiment variation of the attachment of the guide member.

FIG. 3 illustrates a variation of the receptacle 12 of FIG. 1. The jointed receptacle 21 illustrated here has a joint 22, which supports the guide member 15 in a pivoting manner. This enables a particularly simple adjustment to process parameters, in that the guide member 15 is pivoted about the joint 22.

Figure 4:
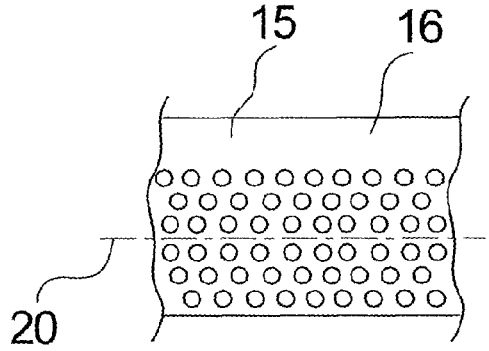
FIG. 4 illustrates a first embodiment variation of the guide member.

FIG. 4 illustrates a particularly advantageous arrangement of the rows of holes in a top view. Tests have shown that particularly uniform fabrics can be produced using this arrangement, if three rows of holes each are arranged above and beneath the lower edge 20 of the guide member 14.

Figure 5:
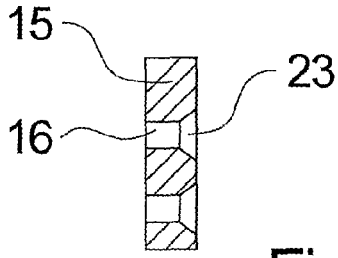
FIG. 5 illustrates a second embodiment variation of the guide member.

FIG. 5 shows an embodiment of the bores 16 having a cone-shaped outlet opening 23. In this manner the air flowing out of the bores 16 is evenly distributed in the region of the slot 10.

Figure 6:
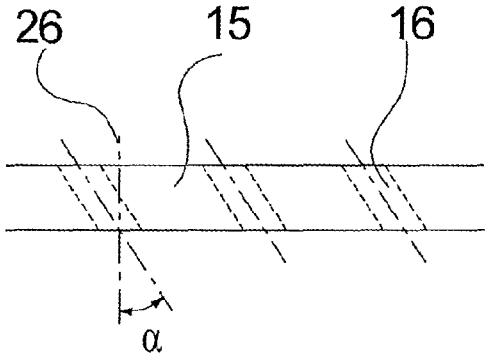
FIG. 6 illustrates a third embodiment variation of the guide member.

FIG. 6 illustrates the view of an alternative embodiment of the guide member 15 in the conveying direction. The bores 16 are arranged in a twisted manner as opposed to the orthogonal 26 of the guide member 15 at a setting angle $\alpha$. In this manner, an angular momentum effect can additionally be exerted onto the filaments.

Figure 7:
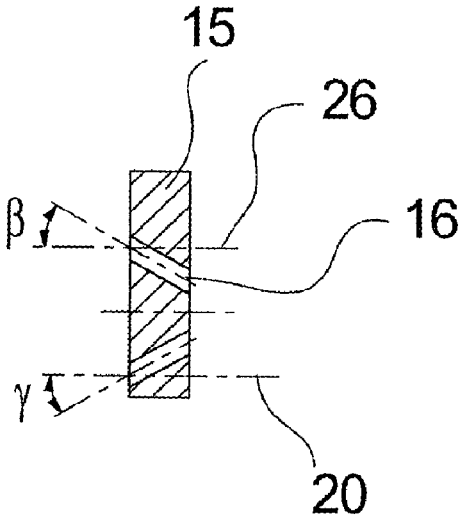
FIG. 7 illustrates a fourth embodiment variation of the guide member.

FIG. 7 shows another alternative embodiment of the guide member 15. The upper row of holes is aligned in the conveying direction at an inflow angle $\beta$, as opposed to the orthogonal 26 of the guide member 15. The lower row of holes is aligned at an outflow $\gamma$ in the opposite direction. The in and outflow behavior of the air in the slot can be aided particularly well in this manner.

Figure 8:
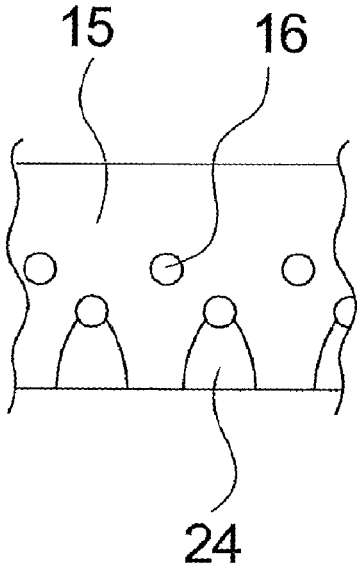
FIG. 8 illustrates a fifth embodiment variation of the guide member.
Figure 9:
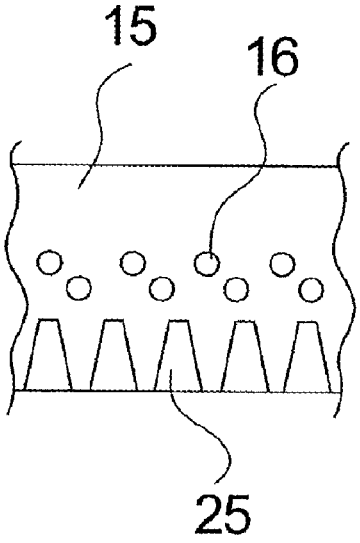
FIG. 9 illustrates a sixth embodiment variation of the guide member.

FIGS. 8 and 9 illustrate a further improvement of the guide member 15. In FIG. 8 the lower row of holes is equipped with notches 24 that are directly connected to the lower bores 16. In this manner the inflowing air can be evenly distributed across the length of the slot 10. On the other hand, in FIG. 9 the notches 25 are arranged at a distance beneath the rows of holes.

Even though the alternative embodiments in FIGS. 5, and 7 to 9 show only two rows of holes each, the embodiments are also possible for any desired number of rows of holes and arrangements of the holes 16.

While various embodiments of the invention have been particularly shown and described, it will be understood by those skilled in the art that various changes in form and details may be made therein without departing from the spirit and scope of the invention as defined by the appended claims.

LIST OF REFERENCE SYMBOLS

1 melt source
2 melt line
3 spinning unit
4 spinning nozzles
5 filament bundle
6 drawing nozzle
7 intake region
8 drawing region
9 compressed air feed
10 slot

11 receptacle
12 receptacle
13 guide member
14 notch
15 guide member
16 bore
17 screwed connection
18 fabric
19 conveyor belt
20 lower edge of guide member
21 jointed receptacle
22 joint
23 outlet opening
24 notch
25 notch
26 orthogonal of the guide member
27 bar
28 threaded bore
α setting angle
β inflow angle
γ outflow angle

What is claimed is:

1. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and wherein air from the environment is passively exchanged through the plurality of bores during operation; and wherein at least part of the bores of the guide member have an angle (α) of greater than 0° to the orthogonal of the guide member and transverse to the conveying direction.

2. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and a second guide member extending across the length of the slot and positioned on the opposite side of the slot from the first guide member, the second guide member having a plurality of notches aligned parallel to the conveying direction of the drawing nozzle; and wherein air from the environment is passively exchanged through the plurality of bores during operation.

3. The device according to claim 1, wherein the first guide member having a plurality of bores is provided on both sides of the slot.

4. The device according to claim 2, wherein the angular adjustment of at least one of the first and second guide members can be adjusted opposed to the conveying direction of the drawing nozzle.

5. The device according to claim 1, wherein the bores in the guide member are inserted in multiple rows.

6. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and wherein air from the environment is passively exchanged through the plurality of bores during operation; and wherein at least part of the bores are above a lower edge of a second guide member, on the opposite side of the slot as viewed in the conveying direction, and at least part of the bores are beneath the lower edge.

7. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and wherein air from the environment is passively exchanged through the plurality of bores during operation; and wherein at least part of the bores expand toward the interior of the guide member.

8. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and wherein air from the environment is passively exchanged through the plurality of bores during operation; and wherein at least some of the bores terminate on the interior of the guide member in a notch extending in the conveying direction of the filaments.

9. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and wherein air from the environment is passively exchanged through the plurality of bores during operation; and wherein the guide member further includes notches disposed beneath the bores.

10. The device according to claim 1, wherein the angle (α) is in the range of about 10° to 60° transverse to the conveying direction.

11. A device for drawing filaments for the formation of a spunbonded fabric, comprising:

a drawing nozzle forming a slot constructed and arranged to feed filaments from a spinning unit in a conveying direction, a tensile force being exerted for drawing the filaments via compressed air;

a first guide member disposed on the base of the drawing nozzle on a first side of a slot and extending across the length of the slot, the guide member including a plurality of bores that connect a space below the slot to the environment; and wherein air from the environment is passively exchanged through the plurality of bores during operation; and wherein at least one part of the bores of the guide member has an angle (η, γy) of greater than 0° to the orthogonal (26) of the guide member, in or opposite to the conveying direction.

12. The device according to claim 11, wherein the angle (β, γ) in or against the conveying direction is in the range of about 10° to 60°.

13. The device according to claim 1, wherein the diameter of the bores is in the range of about 0.5 to 10 mm.

* * * * *

UNITED STATES PATENT AND TRADEMARK OFFICE

CERTIFICATE OF CORRECTION

PATENT NO. : 8,186,986 B2
APPLICATION NO. : 12/487824
DATED : May 29, 2012
INVENTOR(S) : Holger Schöttler et al.

It is certified that error appears in the above-identified patent and that said Letters Patent is hereby corrected as shown below:

Claim 11, Column 8, Line 2, "(η, γy)" should read -- (β, γ) --.

Signed and Sealed this
Seventh Day of August, 2012

David J. Kappos

David J. Kappos
*Director of the United States Patent and Trademark Office*